US005690045A

United States Patent [19]

Gauthier

[11] Patent Number: 5,690,045

[45] Date of Patent: Nov. 25, 1997

[54] PERSONAL WATERCRAFT LIFT AT TRANSOM

[75] Inventor: Mark W. Gauthier, Grand Haven, Mich.

[73] Assignee: Marine Automation, Inc., Grand Haven, Mich.

[21] Appl. No.: 728,826

[22] Filed: Oct. 10, 1996

[51] Int. Cl.[6] ..... B63B 35/40

[52] U.S. Cl. ..... 114/259; 114/369

[58] Field of Search ..... 114/365, 366, 114/368, 373, 258, 259, 44, 48; 405/3

[56] References Cited

U.S. PATENT DOCUMENTS 4,787,327 11/1988 Porter .
4,878,450 11/1989 Schmidt, Jr. .
5,133,275 7/1992 Maurizio .
5,140,923 8/1992 Wood ..... 114/48
5,170,742 12/1992 Roskelley .
5,193,479 3/1993 Bielefeld .
5,275,505 1/1994 Wilcox .
5,483,912 1/1996 Thomas .
5,544,606 8/1996 Schmidt, Jr. ..... 114/48

*Primary Examiner*—Edwin L. Swinehart
*Attorney, Agent, or Firm*—Price, Heneveld, Cooper, DeWitt & Litton

[57] ABSTRACT

A hoisting mechanism attached to the transom of pleasure-craft is provided which raises and lowers a platform to hoist personal watercraft, such as a water jet propelled personal watercraft, into and out of the water with a minimal amount of apparatus externally of the transom.

17 Claims, 5 Drawing Sheets

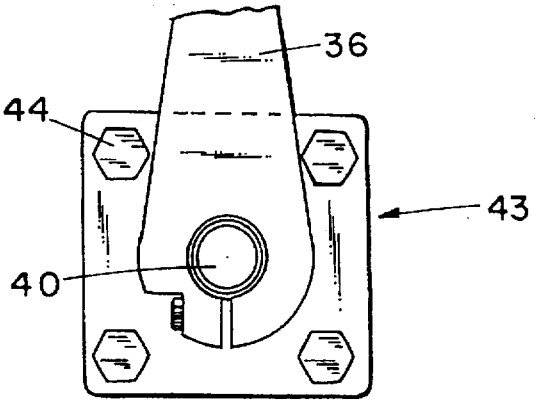
FIG 5
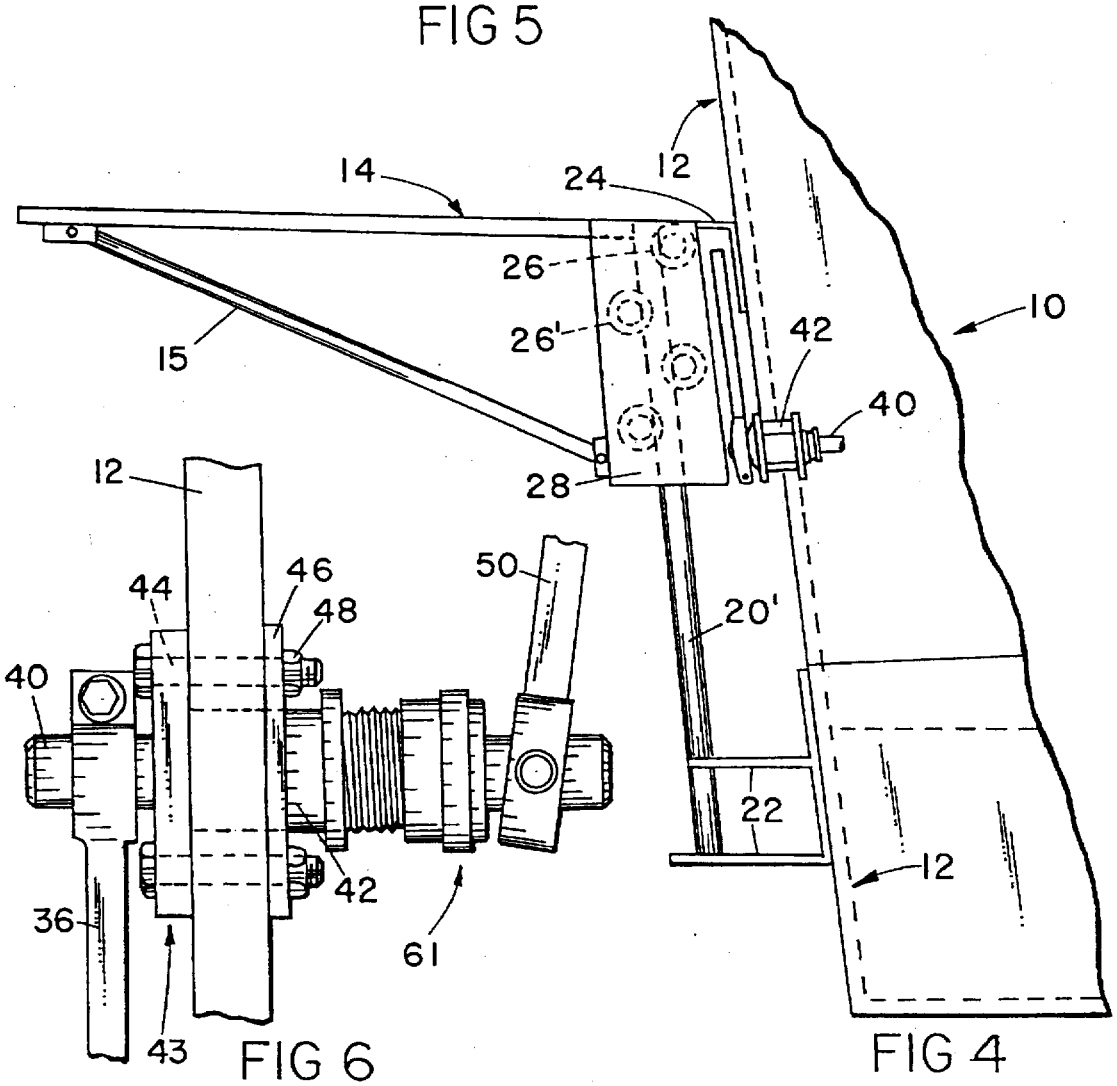
FIG 6
FIG 4

PERSONAL WATERCRAFT LIFT AT TRANSOM

BACKGROUND OF THE INVENTION

This invention relates to boats and particularly to apparatus for raising and lowering a personal watercraft platform at the rear of larger boats such as pleasurecraft.

Small personal watercraft such as those which are water jet propelled have become tremendously popular for water related sports and other activities, in recent years. Often it is desired to take such a personal watercraft along with a large pleasure boat for a variety of reasons including errand running, sports activities, assisting swimmers, etc. Towing of these personal watercraft behind the larger pleasure boat is not practical. It is therefore desirable to be able to hoist the personal watercraft out of the water onto the larger boat, and later lower the personal watercraft to the water. Moreover, it is desirable to do this without sufficient mechanism externally of the pleasurecraft to cause potential safety problems to the rear of the transom, without exposure of functional devices to the environment and without exposed mechanism to detract from aesthetic appeal of the pleasurecraft.

Pleasurecraft used on larger lakes and oceans typically do not have a convenient hoist mechanism for elevating small personal watercraft such as the water jet propelled type popular in recent years. Although there is presently on the market a personal watercraft hoist of the type shown in U.S. Pat. No. 4,878,450, except using hydraulic cylinders instead of the noted cables, it is considered that the presently available apparatus does not meet the above desirable criteria.

SUMMARY OF THE INVENTION

An object of this invention is to provide a unique hoisting mechanism at the transom of a pleasurecraft for raising and lowering personal watercraft, the power hoisting and lowering mechanism being basically internally mounted and located, at the interior side of the transom, providing safety, aesthetic appeal and protection of the active power hoist mechanism from the environment.

The novel hoist has a pair of mirror image pivot arms external of the transom and beneath a hoisting platform, connected to a pair of respective pivot shafts extending through the transom to a second pair of internal pivot arms forward of the transom and connected by a common slide beam to a linear power actuator such as a fluid cylinder. The power actuator is also positioned internally of the transom for pivoting the internal arms, the shafts and the external arms, and thereby raising and lowering the platform conveniently, easily and safely.

The platform is guided and stabilized in its vertical movement by rollers on guide rods located on the external side of the transom and spaced from each other. The external arms may also have wobble connections with the shafts to accommodate the curvature of the transom.

These and other objects, advantages and features of the invention will become apparent upon studying the following specification in conjunction with the drawings.

BRIEF DESCRIPTION OF THE DRAWINGS

FIG. 4 is a fragmentary side elevational view of the exterior apparatus and transom in FIGS. 1 and 2;

FIG. 5 is a fragmentary elevational view of a transom clamp which attaches to the transom;

FIG. 6 is a fragmentary sectional view of a shaft which extends through the transom and the connecting links internally and externally of the transom.

DESCRIPTION OF THE PREFERRED EMBODIMENT

Figure 1:
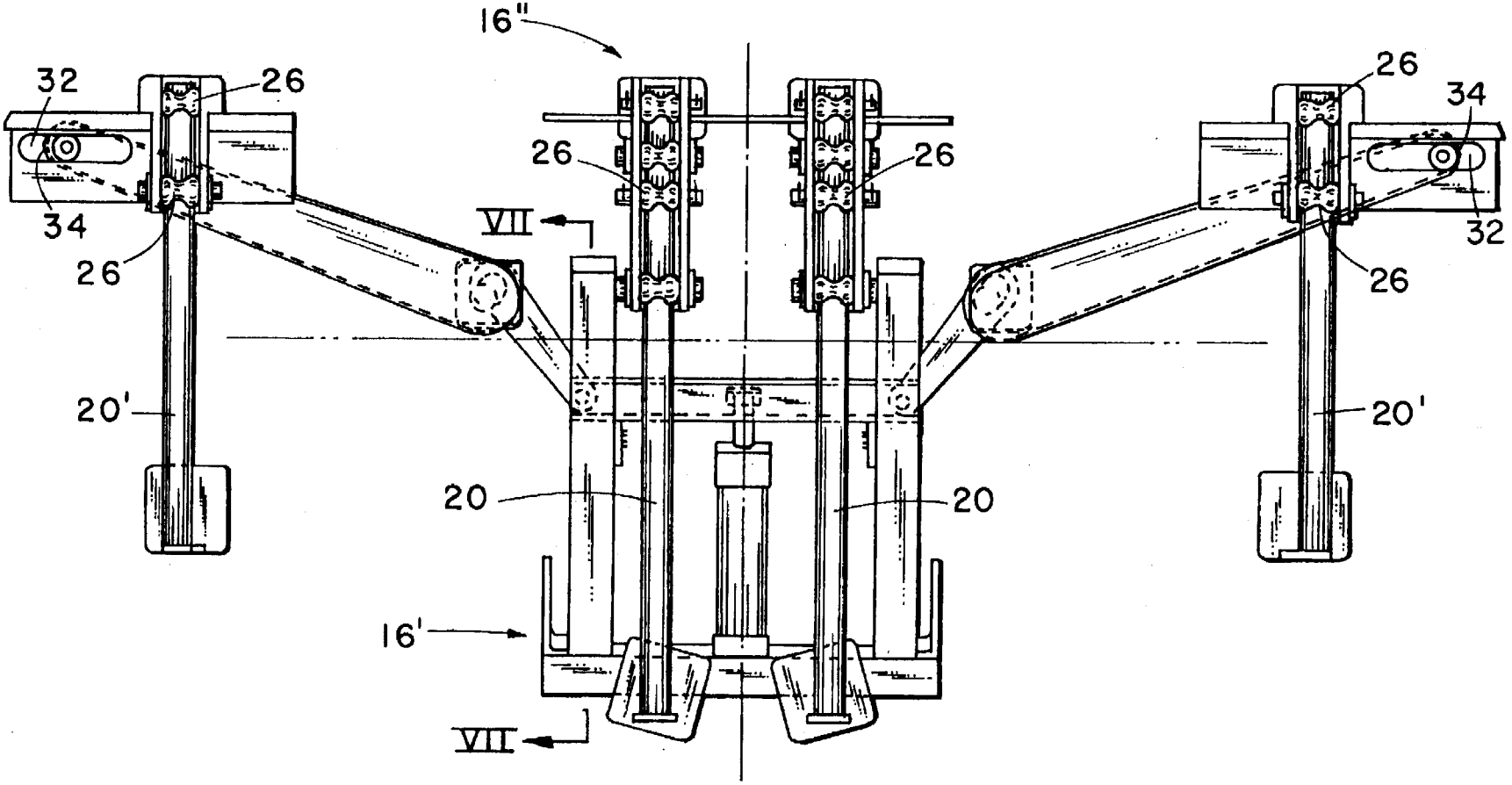
FIG. 1 is an elevational view showing the mechanism of this invention.
Figure 2:
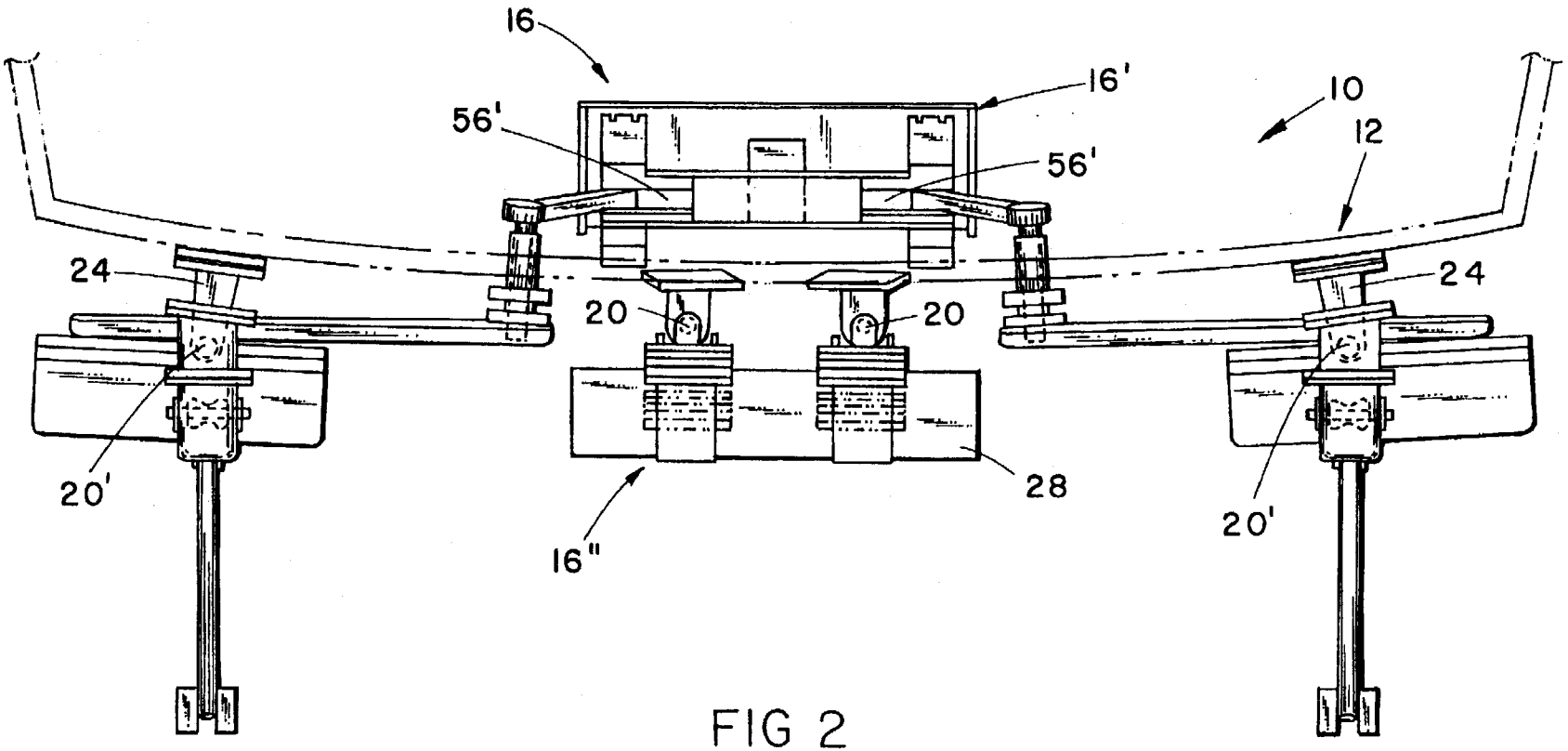
FIG. 2 is a fragmentary top plan view of a pleasureboat transom attached to the apparatus in FIG. 1.

Referring now specifically to the drawings, there is depicted the rear transom 12 of a pleasureboat 10, the remaining portions of which are conventional and therefore not depicted. The transom, in typical fashion, is curved convexly to the exterior, from side to side. A personal watercraft support platform 14 is shown to the rear of transom 12, this platform being vertically elevated and lowered by special apparatus 16, described in detail below, which includes apparatus 16' internally of the transom and apparatus 16" externally of the transom.

Boat 10 typically includes a plurality of fore to aft stringers or beams 11 at spaced intervals across the width of the craft and on which the internal mechanism 16' can be mounted as by supports (not shown) attached to beams 11.

There is a minimal amount of apparatus externally of the transom. Specifically, the elongated platform extending transversely of the boat has a front curvature matching that of transom 12. Beneath platform 14 is a plurality of four vertically oriented guide rods (FIG. 1) including two centrally positioned rods 20 and a pair of rods 20' each spaced an equal amount on opposite sides of the center rods 20. Lower ends of these rods are mounted to brackets 22 which are affixed to the exterior of the boat transom 12. The upper ends of these rods are affixed to an L-shaped bracket 24 also affixed to the exterior of transom 12. Cooperating with each of these guide rods is a plurality of concave rollers 26 mounted by brackets 28 to platform 14, to the front and rear of each rod, to cause the rollers to follow the rod up and down with movement of the platform up and down. The cooperative effect between these rollers and rods stabilizes the platform laterally as well as retaining it a freed distance from the boat transom 12. On four locations there are tube supports 15 attached to both mounting brackets' 28 two locations and mounting brackets 30 which support platform 14. Beneath the forward edge of platform 14 is a pair of spaced slotted brackets 30 affixed to the platform to travel therewith. Each of these brackets 30 has a horizontally elongated slot 32 which receives a roller 34 rotationally mounted on the outer ends of a pair of pivot links 36. Vertical pivoting of these links about a pivot axis on the opposite ends of links 36 causes the brackets 30 and platform 14 to be raised or lowered.

Figure 3:
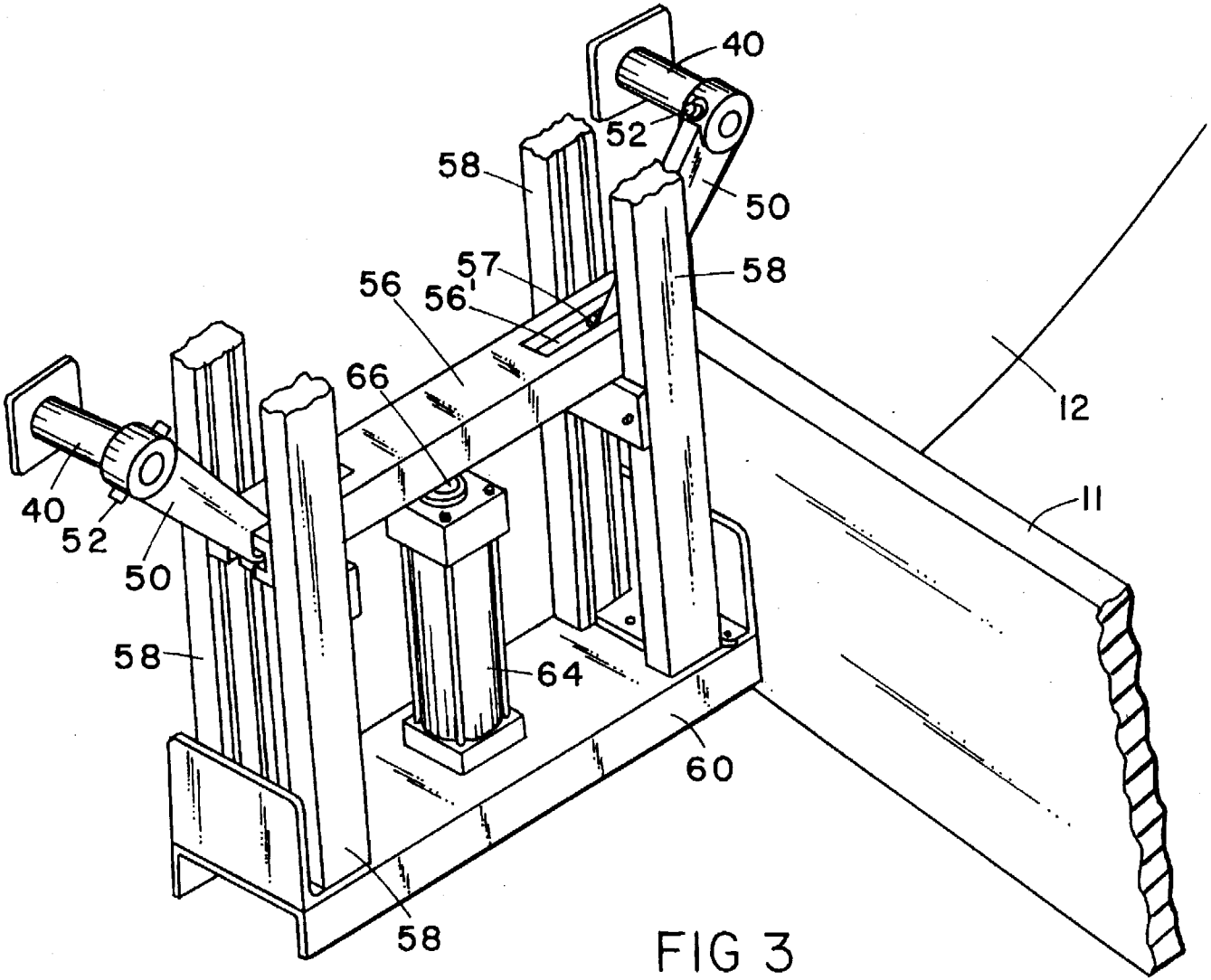
FIG. 3 is a fragmentary perspective view of the interior of the transom.
Figure 7:
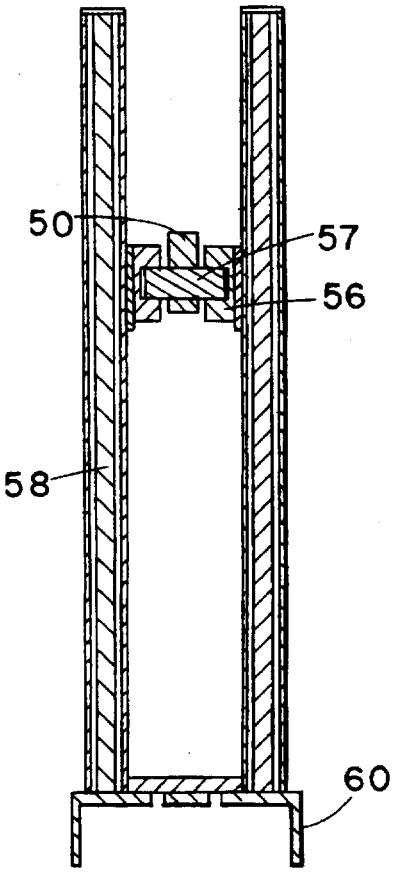
FIG. 7 is a cross-sectional view of the internal mechanism of the present invention taken along line VII—VII of FIG. 1.
Figure 8:
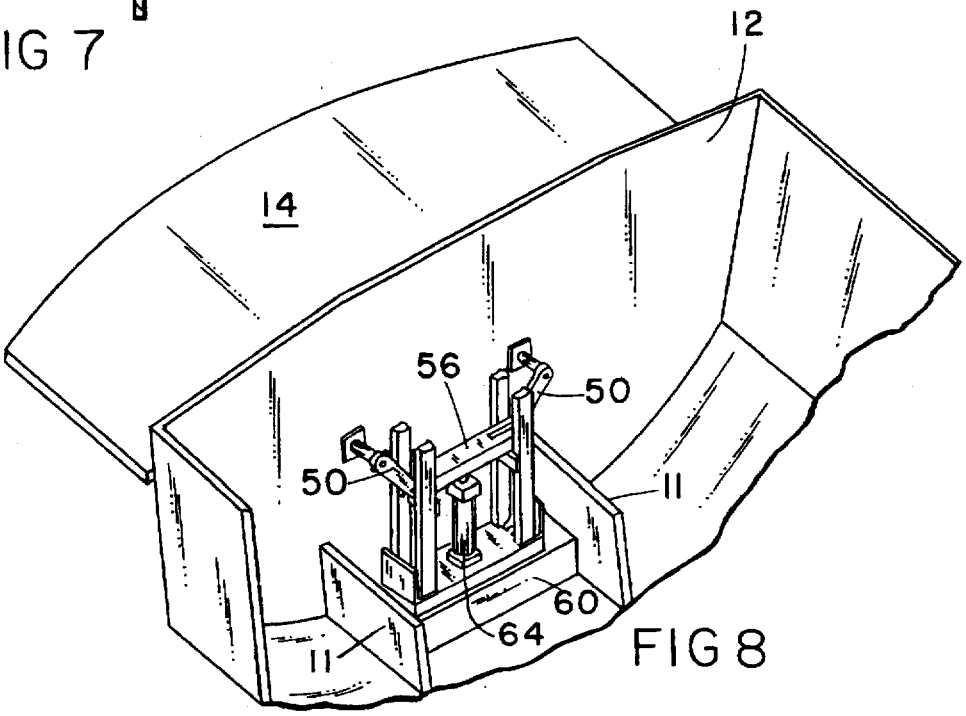
FIG. 8 is a perspective view of the portion of the pressent invention interior of the transom.

The opposite ends of pivot links 36 are mounted on a pivot shaft 40 which extends through transom 12 (FIGS. 4 and 6) to its interior side inside of bearing 42. This bearing has a transom clamp 43 (FIG. 5) which connects bearing 42 to transom 12. Transom clamp 43 includes a peripheral flange on the exterior side of transom 12 (FIG. 6) through which four studs 44 extend. These four studs also extend through the transom and through a fixture plate 46 on the inside of the transom. Nuts 48 secure the bearing 42, studs 44 and fixture plate 46 to the transom 12 in a watertight connection. Nut 61 is screwed around shaft 40 and onto bearing 42 to extrude sealing package material around shaft 40 for additional watertight connection. Pivot arms 36 are spline coupled to shaft 40 such that rotation of the shaft pivots these arms. Pinned to the inner ends of shafts 40 is another pair of pivot arms 50 located on the interior side of transom 12. The connection of pivot arms 50 to shafts 40 is a trunion connection and includes a rocking action to allow an angular adjustment between these elements as the shafts are pivoted, to accommodate the curvature of the transom. This rocking action includes a transverse pin 52 extending through the ends of pivot arms 50 at shafts 40, fitted within a correspondingly shaped groove adjacent the ends of the shafts. The opposite ends of pivot arms 50 are connected by a slot and pin connection to a common transverse beam 56, the ends of which have elongated vertical guides 56' which include slotted standards therein to receive cylindrical pins 57 that act as rollers on the ends of pivot arms 50 (FIG. 7). Vertical movement of beam 56 is guided by a pair of vertical sleeves 58, the lower ends of which are affixed on a fixed bracket 60 extending between and mounted to the inner faces of the two inwardmost boat hull beams 11 (FIG. 3). Also secured to beam 60 at its center is a vertical fluid cylinder actuator 64 having an extendible piston rod 66 actuated by an internal piston in cylinder 64 in conventional fashion. The upper end of cylinder rod 66 is attached to the center of member 56.

In operation, therefore, extension of fluid cylinder actuator 64 will raise member 56 which thus pivots the interior pivot arms 50 about the axis of shafts 40. Rotation of shafts 40 by elevation of internal pivot arms 50 causes downward pivotal movement of exterior pivot arms 36. The outer ends of pivot arms 36 thus cause rollers 34 to force brackets 30 downwardly, lowering platform 14. Retraction of fluid cylinder actuator 64 reverses this movement to cause platform 14 to be elevated.

The resulting mechanism is not only effective for raising and lowering a personal watercraft relative to a pleasurecraft, but also does not detract from the aesthetic appeal of the larger craft, is safe and easy to operate, and can be mounted readily on existing pleasurecraft.

Conceivably those in this field will consider various modifications which can be made to suit a particular craft. It is intended that the invention is not to be limited to the specific preferred embodiment disclosed and depicted herein, but only by the scope of the appended claims as interpreted including the doctrine of equivalents.

The embodiments of the invention in which an exclusive property or privilege is claimed are defined as follows:

1. A transom mountable lifting device for a boat which includes a transom having an interior and an exterior;

said lifting device comprising:

a platform for location at said transom exterior;

a pair of external pivot arms for location at said transom exterior, operably associated with said platform to move up or down therewith;

said pair of external pivot arms being arranged in mirror image to each other and movable up or down simultaneously to lift or lower said platform;

a pair of pivot shafts extendable through said transom between its interior and exterior;

said pair of external pivot arms being connected to said pivot shafts to pivot therewith;

a pair of internal pivot arms for location at said interior of said transom, in mirror image to each other, and operably connected to said pivot shafts to pivot therewith; and a power actuator for location at said transom interior, operably associated with said pair of internal pivot arms, and movable to shift said pair of internal pivot arms, said pair of pivot shafts, and said pair of external pivot arms to lift or lower said platform.

2. The transom mountable lifting device in claim 1 including a plurality of vertical guide rods for location external of said transom, spaced from each other, a plurality of rod engaging rollers mounted to said platform at spaced intervals across the width of said platform, for stabilizing said platform when lifted and lowered.

3. The transom mountable lifting device in claim 2 wherein said rollers are in groups, one group for each of said guide rods, and each group comprising a plurality of rollers on opposite sides of said guide rods.

4. The transom mountable lifting device in claim 3 wherein said guide rods comprise two outer rods adjacent the end portions of said platform, and two inner rods adjacent the central portions of said platform.

5. The transom mountable lifting device in claim 1 wherein said pivot shafts include transom clamps.

6. The transom mountable lifting device in claim 1 wherein said external arms comprise a trunion connection to said pivot shafts to allow for curvature of said transom.

7. The transom mountable lifting device in claim 1 wherein said power actuator comprises a fluid cylinder oriented vertically, a transverse beam mounted on said fluid cylinder to be raised and lowered by said fluid cylinder, and said internal pivot arms each have a connection to opposite ends of said beam to be pivoted by said raised and lowered beam.

8. The transom mountable lifting device in claim 7 including vertical guides for said beam.

9. The transom mountable lifting device in claim 8 wherein said vertical guides comprise a pair of spaced, slotted standards.

10. The transom mountable lifting device in claim 7 wherein said connections to said beams comprise slot and pin connections.

11. A transom mountable lifting device for a boat which includes a transom having an interior and an exterior;

said lifting device comprising:

a platform for location at said transom exterior;

a pair of external pivot arms for location at said transom exterior, operably associated with said platform to move up or down therewith;

said pair of external pivot arms being arranged in mirror image to each other and movable up or down simultaneously to lift or lower said platform;

a pair of pivot shafts having transom clamps, said pivot shafts extendable through said transom between its interior and exterior;

said pair of external arms having a trunion connection to said pivot shafts to pivot therewith and to allow for curvature of said transom;

a pair of internal pivot arms for location at said interior of said transom, in mirror image to each other, and operably connected to said pivot shafts to pivot therewith;

a power actuator for location at said transom interior, operably associated with said pair of internal pivot arms, and movable to shift said pair of internal pivot arms, said pair of pivot shafts, and said pair of external pivot arms to lift or lower said platform;

a plurality of vertical guide rods for location external of said transom, said guide rods having a plurality of rod engaging rollers and mounted to said platform at spaced intervals across the width of said platform, for stabilizing said platform when lifted and lowered.

12. The transom mountable lifting device in claim 11 wherein said rollers are in groups, one group for each of said guide rods, and each group comprising a plurality of rollers on opposite sides of said guide rods.

13. The transom mountable lifting device in claim 12 wherein said guide rods comprise two outer rods adjacent the end portions of said platform, and two inner rods adjacent the central portions of said platform.

14. The transom mountable lifting device in claim 11 wherein said power actuator comprises a fluid cylinder oriented vertically, a transverse beam mounted on said fluid cylinder to be raised and lowered by said fluid cylinder, and said internal pivot arms each have a connection to opposite ends of said beam to be pivoted by said raised and lowered beam.

15. The transom mountable lifting device in claim 14 including vertical guides for said beam.

16. The transom mountable lifting device in claim 15 wherein said vertical guides comprise a pair of spaced, slotted standards.

17. The transom mountable lifting device in claim 14 wherein said connections to said beams comprise slot and pin connections.

* * * * *